US006208962B1

(12) United States Patent
Ozawa

(10) Patent No.: US 6,208,962 B1
(45) **Date of Patent: *Mar. 27, 2001**

(54) SIGNAL CODING SYSTEM

(75) Inventor: Kazunori Ozawa, Tokyo (JP)

(73) Assignee: NEC Corporation (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/053,930

(22) Filed: Apr. 2, 1998

(30) Foreign Application Priority Data

Apr. 9, 1997 (JP) ..... 9-090415

(51) Int. Cl.[7] ..... G10L 19/04

(52) U.S. Cl. ..... 704/230; 704/204; 704/219

(58) Field of Search ..... 704/219, 223, 704/229, 200, 208, 230, 217, 204, 205, 203, 216, 218

(56) References Cited

U.S. PATENT DOCUMENTS

| | | | | |
|---|---|---|---|---|
| 5,485,581 | * | 1/1996 | Miyano et al. | 704/223 |
| 5,737,484 | * | 4/1998 | Ozawa | 704/219 |
| 5,765,127 | * | 6/1998 | Nishiguchi et al. | 704/208 |
| 5,787,389 | * | 7/1998 | Taumi et al. | 704/219 |
| 5,819,212 | * | 10/1998 | Matsumoto et al. | 704/219 |
| 5,826,226 | * | 10/1998 | Ozawa | 704/223 |
| 5,857,168 | * | 1/1999 | Ozawa | 704/229 |

FOREIGN PATENT DOCUMENTS 4-344699 12/1992 (JP) ..... G10L/9/14

OTHER PUBLICATIONS

Nakamizo, "Signal Analysis and System Identification," Corona K>K>, 1998, pp. 82–87.

Nomura, T., et al., "LSP Coding Using VQ–SVQ With Interpole in 4.075 kbps M–LCELP Speech Coder," (Proc. Mobile Multimedia Communications), pp. B.2.5, 1993.

T. Moriya, et al., "Transform Coding of Speech Using A Weighted Vector Quantizer" IEEE Journal on Selected Areas in Communications, vol. 6, No. 2, Feb. 1988, pp. 425–431.

N. Iwakami, et al., High–Quality Audio–Coding At Less Than 64 Kbits/s By Using Transform–Domain Weighted Interleave Vector Quantization (TWINVQ), Proc. ICASSP–95, 1995, pp. 3095–3098.

(List continued on next page.)

*Primary Examiner*—Richemond Dorvil
(74) *Attorney, Agent, or Firm*—Ostrolenk, Faber, Gerb & Soffen, LLP

(57) ABSTRACT

For voice and musical signal, a signal coding system which can obtain good sound quality even at a low bit rate is provided. The signal coding system predicts an input signal in a predicting circuit and performs orthogonal transformation in a first orthogonal transformation circuit of a predicted residual error signal. In a coefficient calculating circuit, a coefficient of a smaller degree is calculated for expressing an envelop of the orthogonal transformation coefficient in the orthogonal transformation circuit. In a quantization circuit, quantization is performed by expressing the orthogonal transformation coefficient with a plurality of pulse trains with determining positions for generating a pulse using the output of the coefficient calculating circuit. The envelop of the orthogonal transformation coefficient is expressed by the coefficient with smaller degree. On the basis of the coefficient, the orthogonal transformation coefficient is expressed by a plurality of pulse trains to perform more efficient coding than that of the prior art.

27 Claims, 14 Drawing Sheets

OTHER PUBLICATIONS

J.M. Tribolet, et al., "Frequency Domain Coding of Speech", IEEE Transactions on Acoustics, Speech, and Signal Proc., vol. ASSP–27, No. 5, Oct. 1979, pp. 512–530.

P. Kroon, et al., "Pitch Predictors With High Temporal Resolution", ICASSP 90, vol. 2, $S_2$VA, Speech Processing 2, VLSI, Audio and Electroacoustics, 1990 Int. Conference onf Acoustics, Speech and Signal Processing, Apr. 3–6, 1990, Albuquerque, New Mexico, pp. 661–664.

"Speech and Audio Codings", MoMuC–1, First Intl. Workshop on Mobile Multimedia Communications, Dec. 7–10, 1993, at Waseda University, Tokyo, Japan, Session B2.

Gonzalez–Prelcic N et al. "A Multipulse–Like Wavelet–Based Speech Coder" Applied Signal Processing, 1996, Springer–Verlag, UK, vol. 3, No. 2, pp. 78–87.

Kondoz A M et al. "Speech Coding at 9.6 Kb/s and Below Using Vector Quantized Transform Coder" Area Communication, Stockholm Jun. 13–17, 1988, No. Conf. 9, Jun. 13, 1988, pp. 36–39.

Moriya T et al. "Transform Coding of Speech Using a Weighted Vector Quantizer" IEEE Journal on Selected Areas in Communications, vol. 6, No. 2, Feb. 1988, pp. 425–431.

* cited by examiner

SIGNAL CODING SYSTEM

BACKGROUND OF THE INVENTION

1. Field of the Invention

The present invention relates generally to a signal coding system. More specifically, the invention relates to a signal coding system for coding a voice signal or musical signal at low bit rate and in high quality.

2. Description of the Related Art

Systems for coding a voice signal or a musical signal at high efficiency on a frequency axis have been proposed in T. Moriya et al. "Transform Coding of Speech Using Weighted Vector Quantizer", IEEE Journal on Selected Areas in Communications, Vol. JSAC-6, pp 425 to 431, 1988 or N. Iwakami et al., "High-Quality Audio-Coding at Less Than 64 kbit/Using Transform-Domain Weighted Interleave Vector Quantization (TWINVQ)", Proc. ICASSP-95, pp 3095 to 3098, 1995, for example.

In the method disclosed in any of the foregoing publications, an orthogonal transformation of a voice or musical signals is performed using DCT (Discrete Cosine Transform) of a point N. Then, a DCT coefficient is divided per predetermined number of points M (M·N) for vector quantization per M point using a code book.

By the methods disclosed in the foregoing publications, the following drawbacks are encountered.

At first, when a bit rate is relatively high, relatively high sound quality can be provided. However, when the bit rate is lower, the sound quality becomes lower. The primary cause is that harmonics component of DCT coefficient cannot be expressed in vector quantization in lesser number of quantization bits.

Next, when a dividing point number M is set to be large in order to enhance performance of vector quantization, the number of bits of a vector quantizer increases exponentially for the amount required for vector quantization.

SUMMARY OF THE INVENTION

The present invention has been worked out for solving the drawbacks in the prior art as set froth above. Therefore, it is an object of the present invention to provide a signal coding system which can suppress degradation of acousticity with relatively small arithmetic amount even when a bit rate is low.

A signal coding system, according to the present invention, comprises:

- predicting means for deriving a predictive residual error depending upon a result of prediction of an input signal;
- orthogonal transforming means for deriving an orthogonal transformation coefficient by orthogonal transformation of said predictive residual error;
- coefficient calculating means for expressing an envelop of said orthogonal transformation coefficient with a coefficient of a predetermined degree; and quantizing means for quantizing by expressing the orthogonal transformation coefficient by combination of a plurality of pulse trains depending upon said coefficient thus expressed, for outputting a result of quantization by deriving a spectral parameter from said input signal, the coefficient expressed by said coefficient calculating means and quantization result of said quantizing means in combination.

In the signal coding system according to the present invention, the input signal is predicted and the predicted residual error signal is effected by an orthogonal transformation. Then, a coefficient of smaller degree for expressing the envelop of the orthogonal transformation coefficient, is calculated. Quantization is performed by expressing the orthogonal transformation coefficient with a combination of a plurality of pulse trains with determining the position to generate the pulse. It is also possible to calculate the fine structure of the orthogonal transformation coefficient instead of calculating the coefficient of the envelop of the orthogonal transformation coefficient, or to calculate the fine structure of the orthogonal transformation coefficient in conjunction with calculating the coefficient of the envelop of the orthogonal transformation coefficient. Since the orthogonal transformation coefficient is expressed by a combination of a plurality of pulse trains it is possible to perform coding more efficiently than that of the prior art.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessarily obscuring the present invention.

Figure 1:
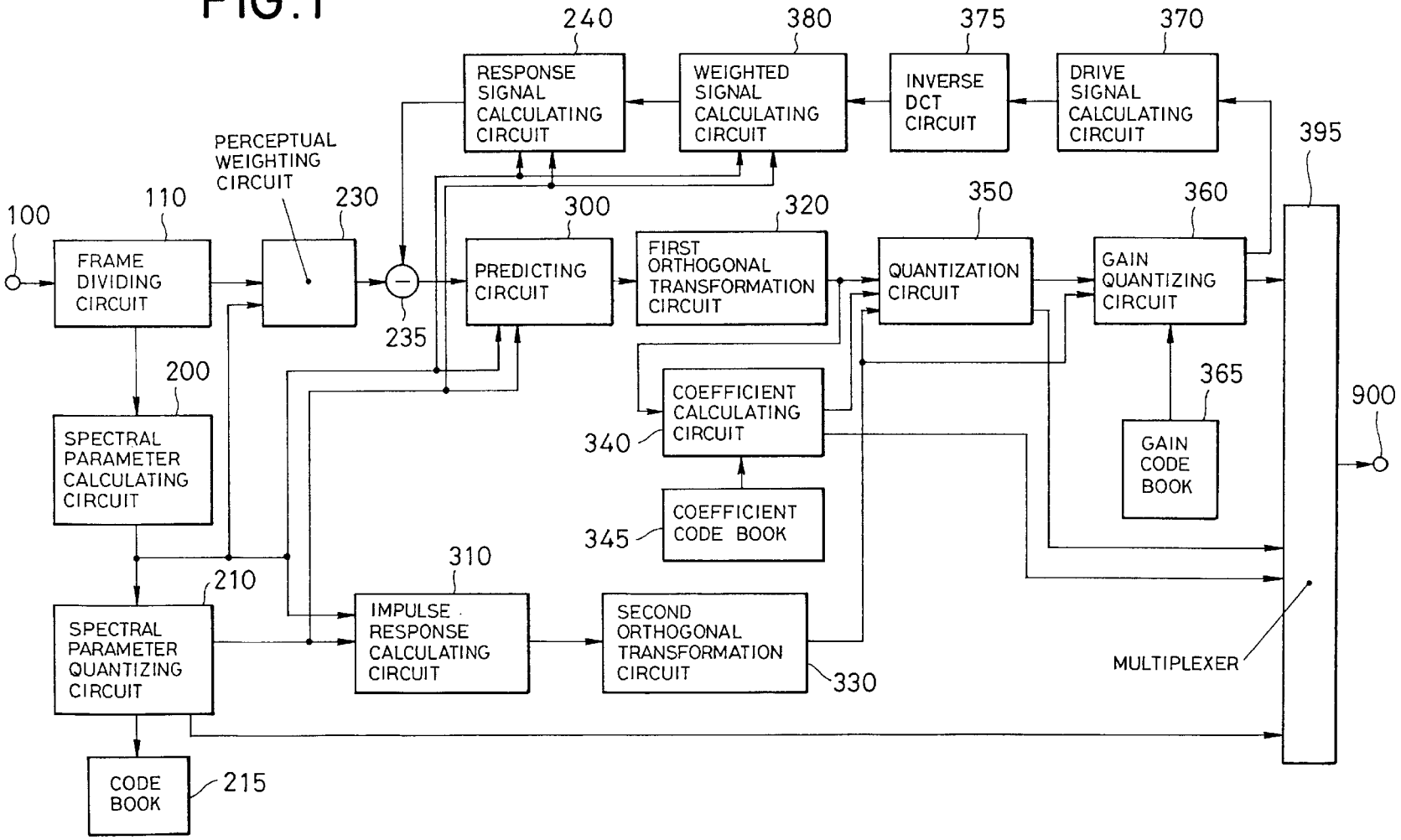
FIG. 1 is a block diagram showing the first embodiment of a signal coding system according to the present invention.

FIG. 1 is a block diagram showing the first embodiment of a signal coding system according to the present invention. In FIG. 1, the shown embodiment of the signal coding system inputs a signal from an input terminal 100. A frame dividing circuit 110 divides the input signal into frames for a predetermined number N of points. A spectral parameter calculating circuit 200 applies a window having longer length (e.g. 24 [ms]) than a frame length (e.g. 20 [ms]) for each frame of a voice, signal to sample a voice, and performs a calculation for spectral parameter in a predetermined number of order (e.g. P=10th order).

Here, in the calculation of the spectral parameter, known LPC analysis, Burg analysis and so forth can be used. In the shown system, Burg analysis is used. Detail of the Burg analysis has been disclosed in Nakamizo, "Signal Analysis and System Identification", Corona K. K., 1988, pp 82 to 87. The disclosure is herein incorporated by reference for the sake of disclosure.

Also, in the spectral parameter calculating circuit 200, a linear predictive coefficient $\alpha i$ (i=1, . . . , P) calculated by Burg analysis is converted into an LSP parameter adapted for quantization and interoperation. For conversion from linear predictive coefficient to LSP, reference is made to Sugamura et al., "Voice Information Compression by Linear Spectrum Pair (LSP) Voice Analysis and Synthesizing System", Paper of Institute of Electronics and Communication Engineers, J64-A, 1981, pp 599 to 606. The disclosure is herein incorporated by reference for the sake of disclosure.

Figure 2:
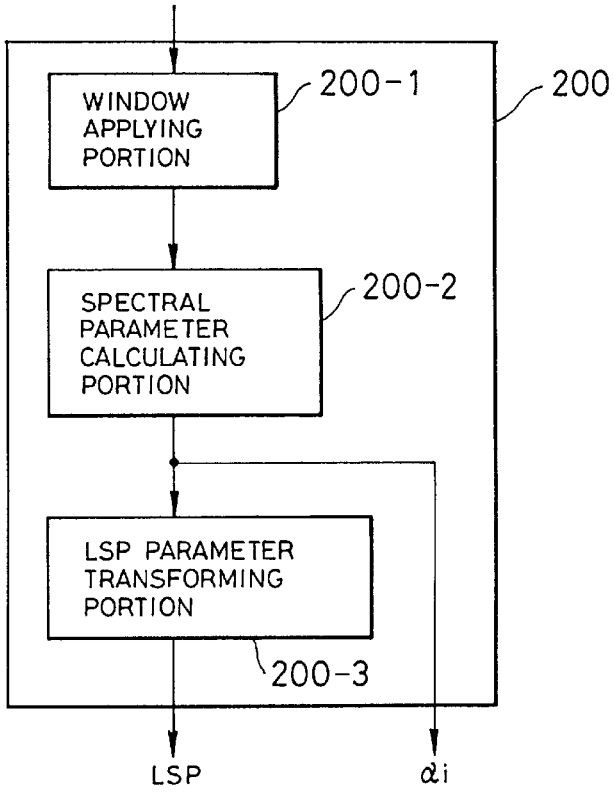
FIG. 2 is an illustration showing an example of a position generating a pulse.

Here, as shown in FIG. 2, the spectral parameter calculating circuit 200 includes a window applying portion 200-1 performing a window applying process, a spectral parameter calculating portion 200-2 performing a calculation of a spectral parameter by the foregoing Burg analysis, and an LSP-parameter converting portion 200-3 which converts the calculated spectral parameter into an LSP parameter.

Returning to FIG. 1, the linear predictive coefficient $\alpha i$ (i=1, . . . , P) of the frame output from the spectral parameter calculating circuit 200 is input to a perceptual weighting circuit 230. On the other hand, the LSP parameter of the frame is input to a spectral parameter quantizing circuit 210.

In the spectral parameter quantizing circuit 210, the LSP parameter of the frame is efficiently quantized using a code book 215 to output a quantized value minimizing skewness using the following equation (1).

$$D_j = \sum_{i}^{P} W(i)[LSP(i) - QLSP(i)_j]^2 \tag{1}$$

It should be noted that, in the foregoing equation (1), LSP(i), $QLSP(i)_j$ and W(i) are respectively an LSP of (i)th degree before quantization, a result of (j)th order after quantization and a weighting coefficient.

In the foregoing discussion, as a method for quantization, a vector quantization method is employed. As the vector quantization method of the LSP parameter, a known method can be employed. A particular method of vector quantization have been disclosed in Japanese Unexamined Patent Publication No. Heisei 4-171500, Japanese Unexamined Patent Publication No. Heisei 4-363000, Japanese Unexamined Patent Publication No. Heisei 5-6199, and in addition, T. Nomura et al., "LSP Coding Using VQ-SVQ With Interpolation in 4.075 kbps M-LCELP Speech Coder", (Proc. Mobile Multimedia Communications, pp. B. 2.5, 1993). The disclosure is herein incorporated by reference for the sake of disclosure.

The spectral parameter quantizing circuit 210 converts the quantized LSP into the linear predictive coefficient $\alpha'i$ (i=1, . . . , P) to output to an impulse response calculating circuit 310. On the other hand, the spectral parameter quantizing circuit 210 outputs an index indicative of a code vector of quantizing LSP to a multiplexer 395.

Figure 3:
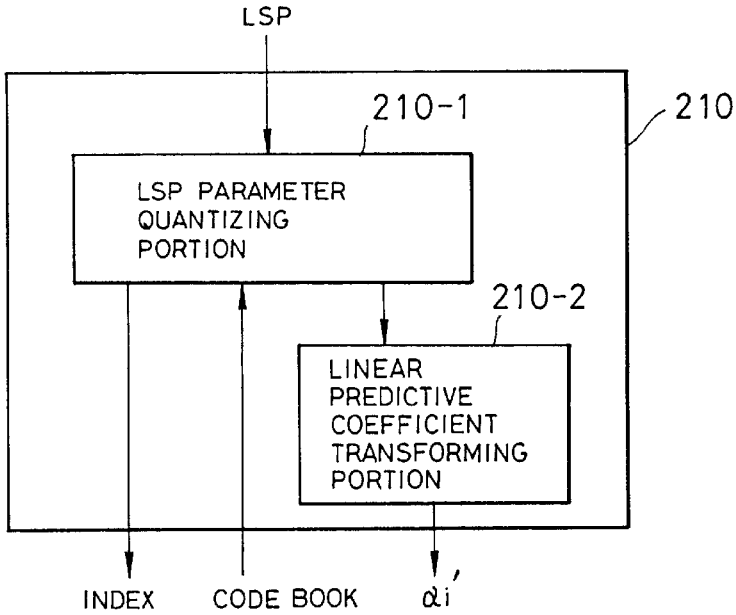
FIG. 3 is an illustration showing an internal construction of a spectral parameter calculating circuit in FIG. 1.

Here, as shown in FIG. 3, the spectral parameter quantizing circuit 210 includes an LSP parameter quantizing portion 210-1 which quantizes the LSP parameter of the frame, and a linear predictive coefficient converting portion 210-2 which converts the quantized LSP into the linear predictive coefficient $\alpha'i$. The LSP parameter quantizing portion 210-1 makes reference to an output of the code book 215 to output the index.

Returning FIG. 1, the impulse response calculating circuit 310 inputs the linear predictive coefficient $\alpha i$ (i=1, . . . , P) before quantization from the spectral parameter calculating circuit 200 and the linear predictive coefficient $\alpha'i$ (i=1, . . . , P) quantized and decoded from the spectral parameter quantizing circuit 210, and calculates an impulse response of a filter having a transfer characteristics H(z) as expressed by the following equation (2).

$$H(z) = \frac{1 - \sum_{i=1}^{P} \alpha_i \gamma_1^i z^{-i}}{1 - \sum_{i=1}^{P} \alpha_i \gamma_2^i z^{-i}} \frac{1}{1 - \sum_{i=1}^{P} \alpha_i' z^{-i}} \tag{2}$$

A response signal calculating circuit 240 receives the linear predictive coefficient $\alpha i$ from the spectral parameter calculating circuit 200 and also receives the quantized and decoded linear predictive coefficient $\alpha'i$ from the spectral parameter quantizing circuit 210. Then, the response signal calculating circuit 240 calculates the response signal for one frame with setting the input signal zero (d(n)=0), using a stored value of a filter memory to output to a subtractor 235. Here, a response signal $x_z(n)$ is expressed by the following equation (3).

$$x_z(n) = d(n) - \sum_{i=1}^{P} \alpha_i \gamma_1^i d(n-i) + \sum_{i=1}^{P} \alpha_i \gamma_2^i y(n-i) + \sum_{i=1}^{P} \alpha_i' x_z(n-i) \tag{3}$$

wherein when $n-i \leqq 0$, $$y(n-i)=p(N+(n-i)) \tag{4}$$

$$x_z(n-i)=s_w(N+(n-i)) \tag{5}$$

Here, N is a frame length. $\gamma_1$, $\gamma_2$ are weighting coefficients controlling an audibility weighting amount. $s_w(n)$ and p(n) are an output signal of the weighting signal calculating circuit and an output signal of a term of denominator in the foregoing equation (2).

The subtractor 235 subtracts one sub-frame of response signal from the perceptual weighting signal to output a resultant value $x_w'$ (n) to a prediction circuit 300.

$$x'_w(n)=x_w(n)-x_z(n) \tag{6}$$

The prediction circuit 300 receives $x_w'$ (n) and performs prediction using a filter having a transfer characteristics F(z) expressed by the following equation (7). And the prediction circuit 300 calculates a predictive residual signal e(n).

$$F(z)=\frac{1-\sum_{i=1}^{P}\alpha_i\gamma_2^i z^{-i}}{1-\sum_{i=1}^{P}\alpha_i\gamma_1^i z^{-i}}\left[1-\sum_{i=1}^{P}\alpha_i' z^{-i}\right] \tag{7}$$

Here, a predictive residual signal e(n) can be calculated by the following equation (8).

$$e(n)=x'_\omega(n)-\sum_{i=1}^{P}\alpha_i\gamma_2^i x'_\omega(n-i)+\sum_{i=1}^{P}\alpha_i\gamma_1^i y(n-i)+\sum_{i=1}^{P}\alpha_i' y(n-i) \tag{8}$$

A first orthogonal transformation circuit 320 performs orthogonal transformation for the output signal e(n) of the prediction circuit 300. Hereinafter, as one example of orthogonal transformation, transformation by DCT is used . Detail of transformation by DCT has been disclosed in J. Tribolet et al., "Frequency Domain Coding of Speech", (IEEE Trans. ASSP, Vol. ASSP-27, pp. 512 to 530, 1979. The disclosure is herein incorporated by reference for the sake of disclosure. The signals after transformation by DCT are assumed to be E(K) (K=0, . . . , N−1). A second orthogonal transformation circuit 330 receives an impulse response from the impulse response calculating circuit 310 to calculate an auto-correlation function r(i) (i=1, . . . , N). Next, the auto-correlation function is transformed by DCT for N points to obtain W(k) (k=0, . . . , N−1).

The coefficient calculating circuit 340 derives the coefficient of a smaller degree P (P<<N) for expressing an envelop of a square value of the orthogonal transformation coefficients E(K) (K=0, . . . , N−1) as the output of the first orthogonal transformation circuit. In practice, a square value $E^2$(K) of an amplitude of respective coefficients of E(K) is derived. Regarding the derived coefficient as a power spectrum to make it symmetric two N points are set. Then, an inverse FFT (Fast Fourier Transform) is performed for two N points to take out the first N point to calculate a pseudo auto-correlation function R(j)=(j=0, . . . , N−1).

On the other hand, in order to express with further smaller degree, the coefficient calculating circuit 340 performs a P-degree LPC analysis by taking out (P+1)st point from the first, among the auto-correlation function of N point, to calculate the P degree linear predictive coefficient $\beta_i$ (i=1, . . . , a P). This is transformed into a P degree of an LSP coefficient. Then, the LSP coefficient is quantized by using a coefficient code book 345 to output the index to a multiplexer 395. Returning the quantized LSP coefficient into the linear predictive coefficient $\beta'_i$, the impulse response l(n) (n=0, . . . , Q−1) (Q≧N) of the filter is derived.

Then, the coefficient calculating circuit 340 derives the auto-correlation function R' (j) (j=1, . . . , N−1) of the Nth point on the basis of the impulse response to make the impulse response to be symmetric to derive two N points. Then, by performing an FFT for two N points to derive EV(k) (k=0, . . . , N−1) from the first N point to obtain output to the quantization circuit 350. EV(k) (k=0, . . . , N−1) is an envelop component of the orthogonal transformation coefficient, set forth above.

Figure 4:
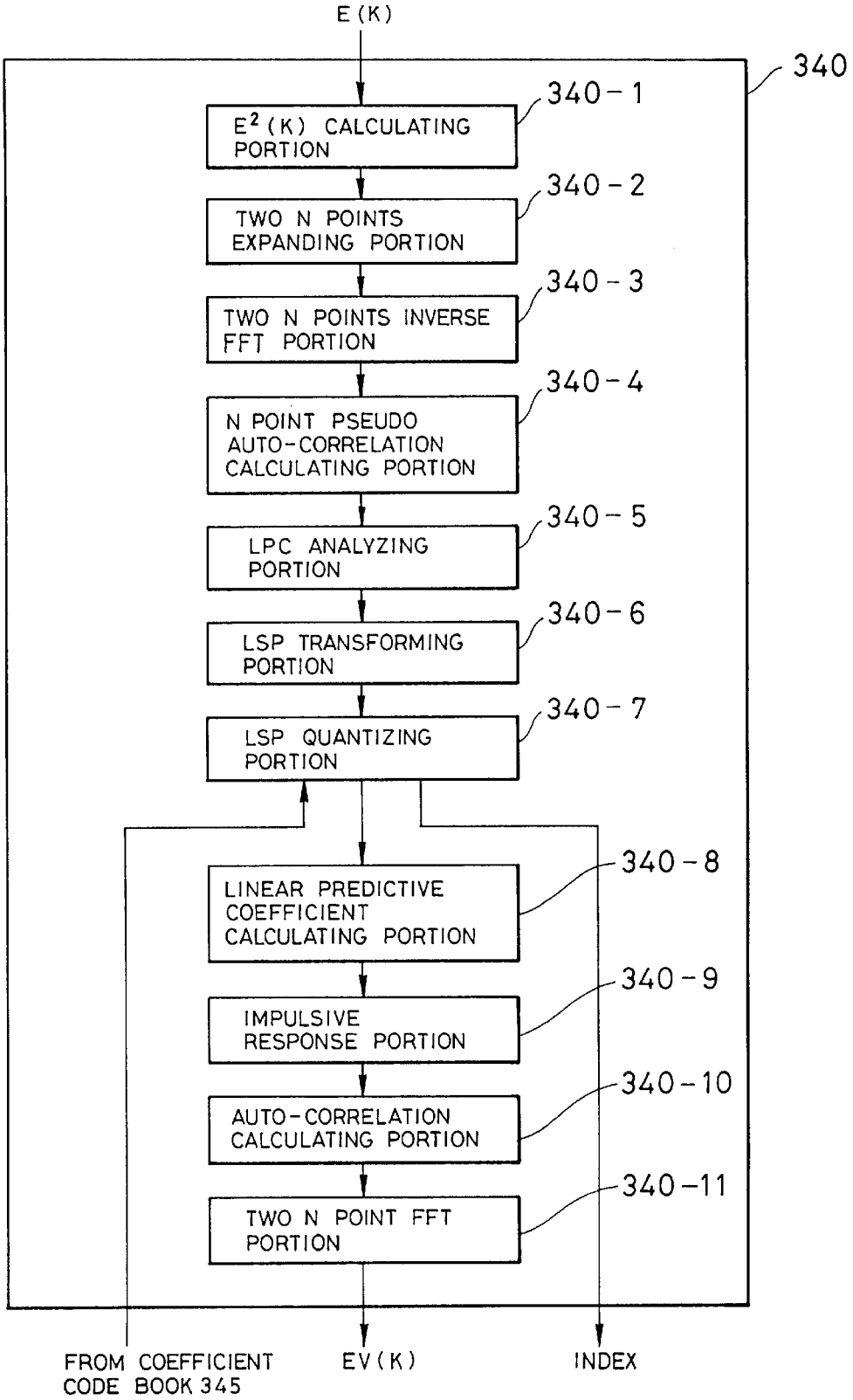
FIG. 4 is an illustration showing an internal construction of a spectral parameter quantizing circuit in FIG. 1.

Here, as shown in FIG. 4, the coefficient calculating circuit 340 includes an $E^2$(K) calculating portion 340-1 calculating the foregoing $E^2$(K) (k=0, . . . , N−1) from the signal E(K) after transformation by DCT, a two N point expanding portion 340-2 expanding the output of the $E^2$(K) calculating portion 340-1 to two N points, a two N points inverse FFT portion 340-3 for performing inverse FFT for the expanded two N points, an N point pseudo auto-correlation calculating portion 340-4 calculating an N point pseudo auto-correlation coefficient R' (j) (j=1, . . . , N−1), an LPC analyzing portion 340-5 calculating a P degree linear predictive coefficient $\beta_i$ by providing the foregoing P-degree LPC analysis, and an LSP transforming portion 340-6 transforming the calculated linear predictive coefficient $\beta_i$ into the P-degree LSP coefficient.

On the other hand, as shown in FIG. 4, the coefficient calculating circuit 340 further includes an LSP quantizing portion 340-7 quantizing the LSP coefficient after transformation by the LSP transforming portion 340-6, a linear predictive coefficient calculating portion 340-8 returning the quantized LSP coefficient into the linear predictive coefficient $\beta'_i$, an impulsive response portion 340-9 for deriving an impulsive response l(n) of the filter from the linear predictive coefficient $\beta'_i$, an auto-correlation calculating portion 340-10 deriving the auto-correlation function R' (j) (j=1, . . . , N−1) of the N point on the basis of the impulse response, and a two N points FFT portion 340-11 deriving EV(k) from the first N point. The LSP quantizing portion 340-7 make reference to the output of the coefficient code book 345 to output the index. It should be noted that coefficient calculating circuit 340 can also calculate coefficients which represent a fine structure of the orthogonal transformation coefficients E(K).

Returning to FIG. 1, the quantizing circuit 350 quantizes the orthogonal transformation coefficient by expressing it with a combination of a predetermined number M of pulses. Here, the number M of the pulses is M<N, the positions of the pulses are differentiated from each other.

On the other hand, assuming that the position of the pulse in the (i)th order is mi and the amplitude thereof is $A_i$, the position to rise (generate) the pulse is selectively determined from the position where the amplitude of the envelop component EV(K) is large. Namely, the orthogonal transformation coefficient EV(K) of the N point is expressed by thinning in time, by generating the M in number of pulses (M<N). Then, the coefficient at the position where the pulse is not generated, is set to be zero and thus a transfer is not performed. Thus, compression of the information is performed. It should be noted that when the pulse is to be risen, it is possible to assign the M in number of pulses to all of the regions of the N point, or to make the total number of pulses to be M by dividing the N point into sub-regions per predetermined number of points to assign the pulses to respective sub-regions.

Figure 5:
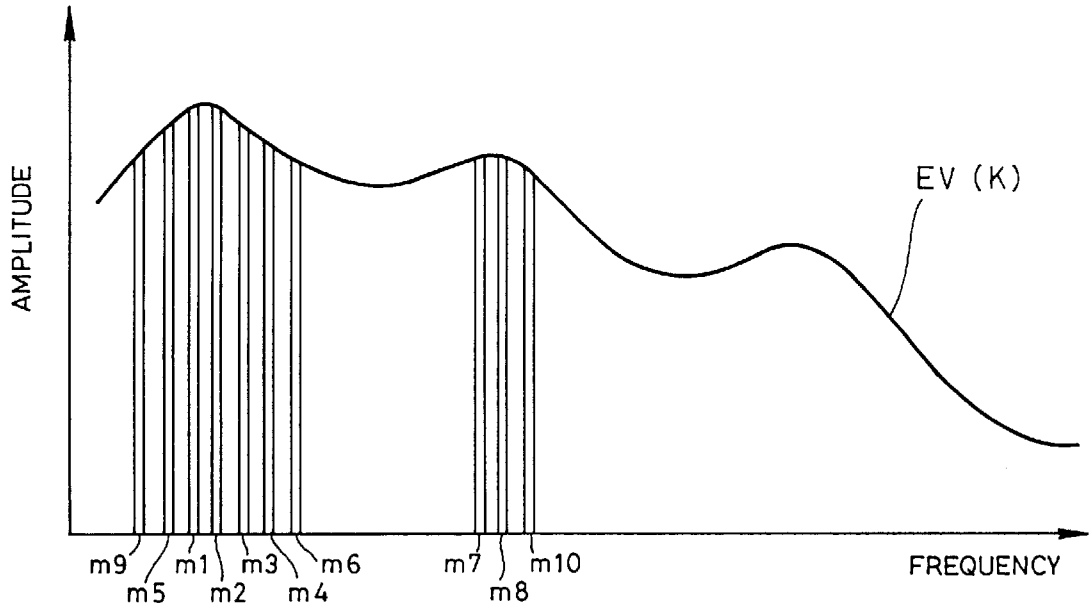
FIG. 5 is an illustration showing an internal construction of a coefficient calculating circuit of FIG. 1.

For example, as shown in FIG. 5, ten pulse positions mi (i=1 to M; M=10) of the ten pulses are selected in the sequential order of amplitude in descending order. In FIG. 5, the vertical axis represents the amplitude and the horizontal axis represents frequency.

After determination of the position of the pulse, the amplitude of the pulse is calculated so that the following equation (9) becomes minimum.

$$D = \sum_{K=0}^{N-1} W(K)\left[E(K) - G \cdot EV(K)\sum_{i=1}^{M} A_i\delta(n-m_i)\right]^2 \quad (9)$$

In the foregoing equation (9), G represents a gain of the pulse. The quantization circuit 350 encodes the amplitude $A_i$ of respective pulse into predetermined number of bits to output the encoded bit number to the multiplexer 395.

Figure 6:
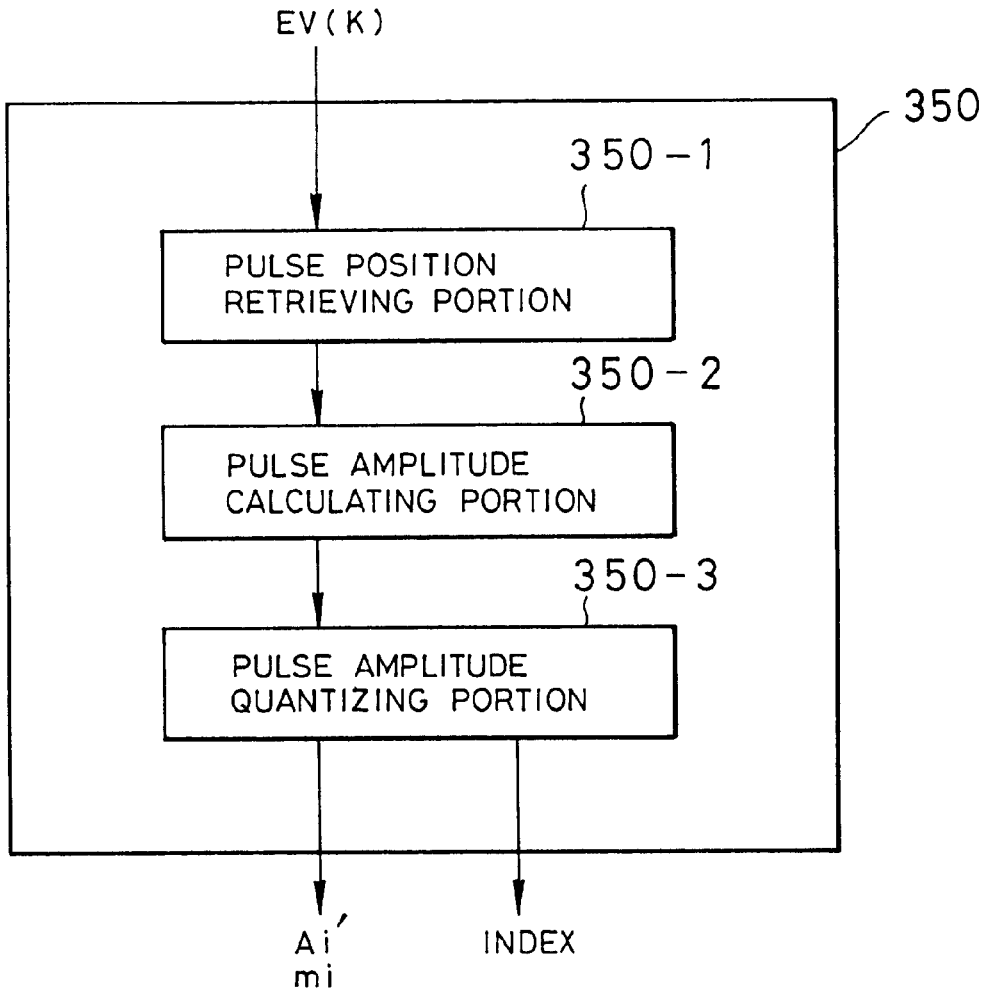
FIG. 6 is an illustration showing an internal constriction of a quantizing circuit of FIG. 1

Here, as shown in FIG. 6, the quantization circuit 350 includes a pulse position retrieving portion 350-1 performing retrieval of the position of the pulse set forth above with taking EV(K) as the input, a pulse amplitude calculating portion 350-2 for calculating the amplitude of the pulse after derivation of the position of the pulse, and a pulse amplitude quantizing portion 350-3 quantizing the amplitude of the pulse calculated by the pulse amplitude calculating portion 350-2. The amplitude $A'_i$ and the pulse position $m_i$ of the pulse output from the pulse amplitude quantizing circuit 350-3 are input to a gain quantizing circuit 360. The index output from the pulse amplitude quantizing portion 350-3 is input to the multiplexer 395.

The gain quantizing circuit 360 retrieves an optimal gain code vector from a gain code book 365 so that the result of the following equation (10) becomes minimum, by using the gain code book 365. Then, the gain quantizing circuit 360 outputs the index representative of the optimal gain code vector to the multiplexer 395, and a gain code vector value to a drive signal calculating circuit 370.

$$D_j = \sum_{K=0}^{N-1} W(K)\left[E(K) - G'_j\sum_{i=1}^{M} A'_i\delta(n-m_i)\right]^2 \quad (10)$$

wherein, $G'_j$ and $A'_i$ are (j)th gain code vector and the amplitude of the (i)th pulse.

The drive signal calculating circuit 370 inputs respective indexes and reads out the code vector corresponding to the indexes. Then, the drive signal calculating circuit 370 derives a driving sound source signal V(K) through the following equation (11).

$$V(K) = G'_j\sum_{i=1}^{M} A'_i\delta(n-m_i) \quad (11)$$

The inverse DCT circuit 375 performs inverse DCT for N points of the drive signal V(K) to obtain V(n), and output to the weighted signal calculating circuit 380.

The weighted signal calculating circuit 380 uses the output of the inverse DCT to calculate a response signal $S_w(n)$ for each sub-frame on the basis of an output parameter of the spectral parameter calculating circuit 200 and an output parameter of the spectral parameter quantizing circuit 210 by the following equation (12), to output a response signal calculating circuit 240.

$$s_\omega(n) = \upsilon(n) - \sum_{i=1}^{P} \alpha_i\gamma_1^i(n-i) + \sum_{i=1}^{P} \alpha_i\gamma_2^i p(n-i) + \sum_{i=1}^{P} \alpha'_i s_\omega(n-i) \quad (12)$$

It should be noted that the multiplexer 395 receives the output index of the spectral parameter quantizing circuit 210, an output index of the coefficient calculating circuit 340, an output index of the quantizing circuit 350 and an output index of the gain quantizing circuit 360 to output to an output terminal 900 by combining in a predetermined sequential order. The order to combine such inputs may be freely set by the user of the shown system.

Figure 7:
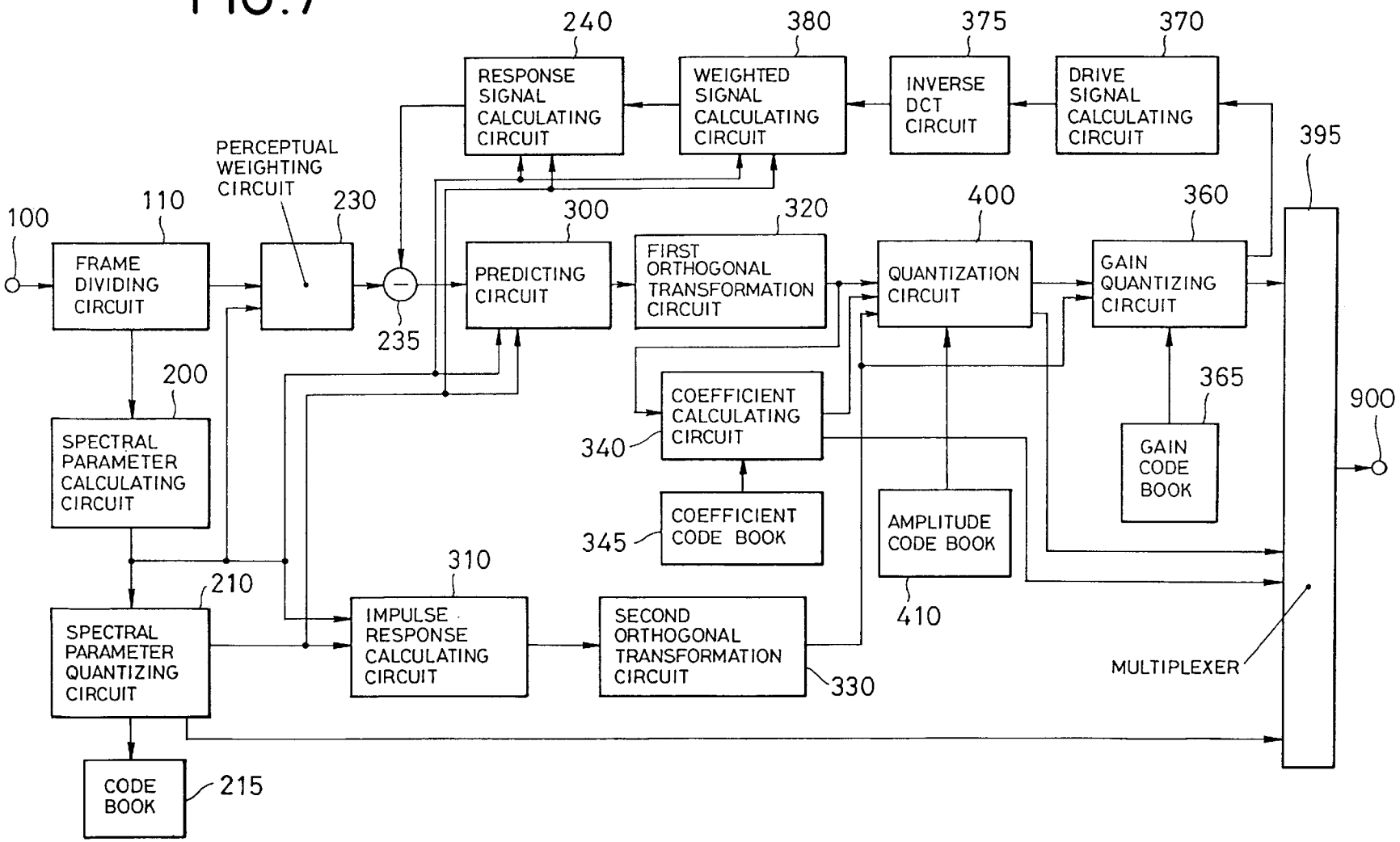
FIG. 7 is a block diagram showing a construction of the second embodiment of a signal coding system according to the present invention.

FIG. 7 is an illustration showing the second embodiment of the signal coding system according to the present invention. In FIG. 7, like components to those in FIG. 1 are identified by like reference numerals and detailed description for such common components will be neglected to avoid redundant discussion to keep the disclosure simple enough for facilitating clear understanding of the present invention.

The system shown in FIG. 7 is differentiated from the system shown in FIG. 1 in a quantization circuit 400 and an amplitude code book 410. Discussion will be given hereinafter for these components.

At first, the quantization circuit 400 reads out an amplitude code vector from the amplitude code book to select the amplitude code vector which makes the following equation (13) minimum.

$$D_j = \sum_{K=0}^{N-1} R(K)\left[E(K) - G\sum_{i=1}^{M} A'_{ij}\delta(n-m_i)\right]^2 \quad (13)$$

wherein $A'_{ij}$ is the amplitude code vector in (j)th order.

Namely, in the shown embodiment, by using the amplitude code book 410, at least one or more amplitudes of the pulses are quantized aggregatingly.

It is also possible to use a polarity code book storing polarity of at least one or more pulses in place of the amplitude code book 410. In such case, polarities of at least one or more pulses are quantized aggregatingly using the polarity code book.

Figure 8:
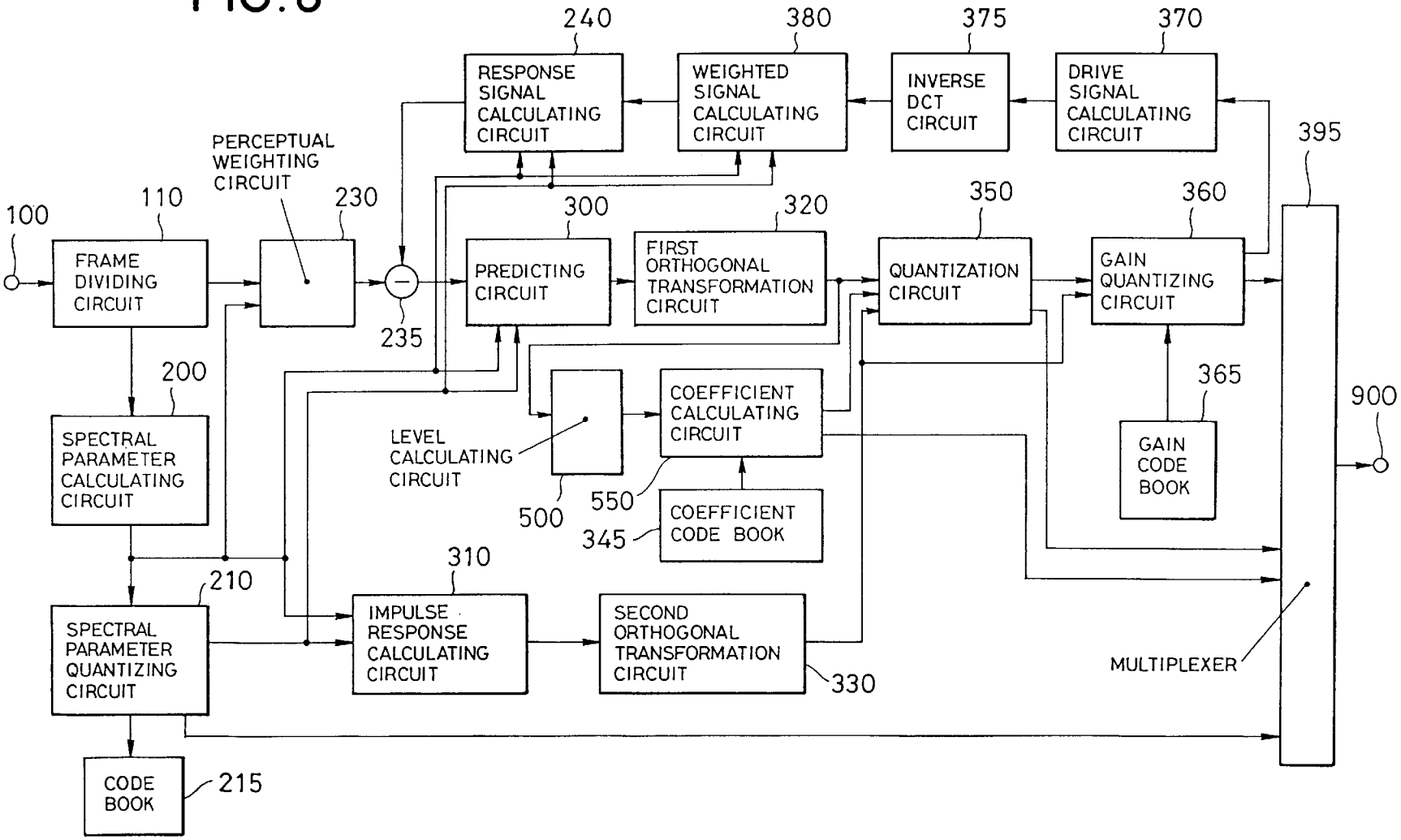
FIG. 8 is a block diagram showing a construction of the third embodiment of a signal coding system according to the present invention.

FIG. 8 is an illustration showing a construction of the third embodiment of the signal coding system according to the present invention. In FIG. 8, like components to those in FIGS. 1 and 7 are identified by like reference numerals and detailed description for such common components will be neglected to avoid redundant discussion to keep the disclosure simple enough for facilitating clear understanding of the present invention. The system illustrated in FIG. 8 is differentiated from the system shown in FIG. 1 in that a level calculating circuit 500 is added.

The level calculating circuit 500 divides the first orthogonal transformation coefficient into bands per predetermined number of coefficients and derives an average level of the first orthogonal transformation coefficient per each band by the following equation (14).

$$LV(j) = \sum_{K}^{M_j} E^2(K) \quad (14)$$

wherein $M_j$ is number of the first orthogonal transformation coefficients in a band of the (j)th order. The level calculating circuit 500 outputs LV(j) (J=1, . . . , L: L is number of bands) to a coefficient calculating circuit 550.

The coefficient calculating circuit 550 takes the output of the level calculating circuit 500 as input to perform the same operation as that of the coefficient calculating circuit 340 of the system shown in FIG. 1.

Figure 9:
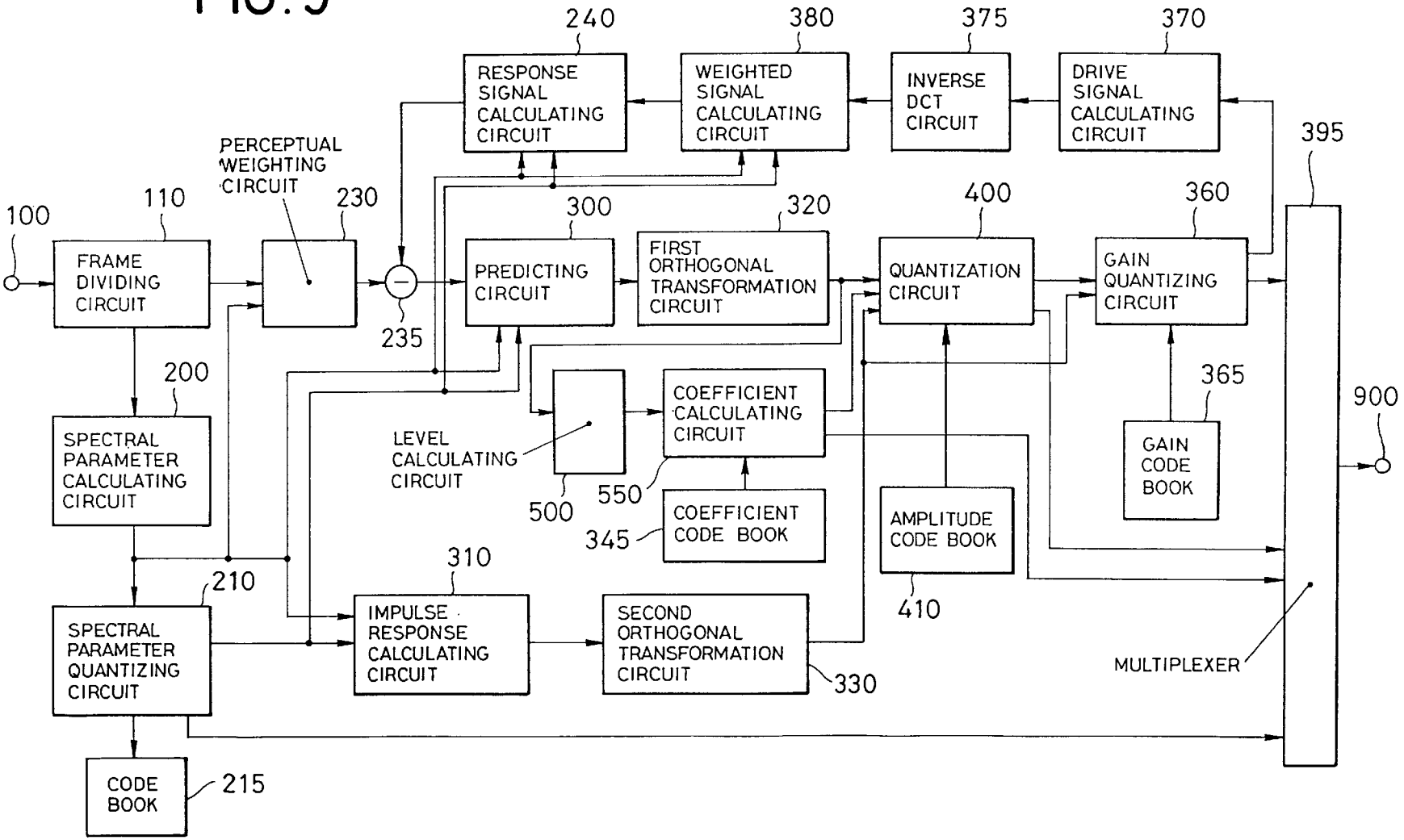
FIG. 9 is a block diagram showing a construction of the fourth embodiment of a signal coding system according to the present invention.

FIG. 9 is an illustration showing a construction of the fourth embodiment of the signal coding system according to the present invention. In FIG. 9, like components to those in FIGS. 1, 7 and 8 are identified by like reference numerals and detailed description for such common components will be neglected to avoid redundant discussion to keep the disclosure simple enough for facilitating clear understanding of the present invention.

The system shown in FIG. 9 is constructed by applying the quantization circuit 400 and the amplitude code book 410 in the system shown in FIG. 7, in the system shown in FIG. 8. The construction and operation other than those are the same as those set forth above.

Figure 10:
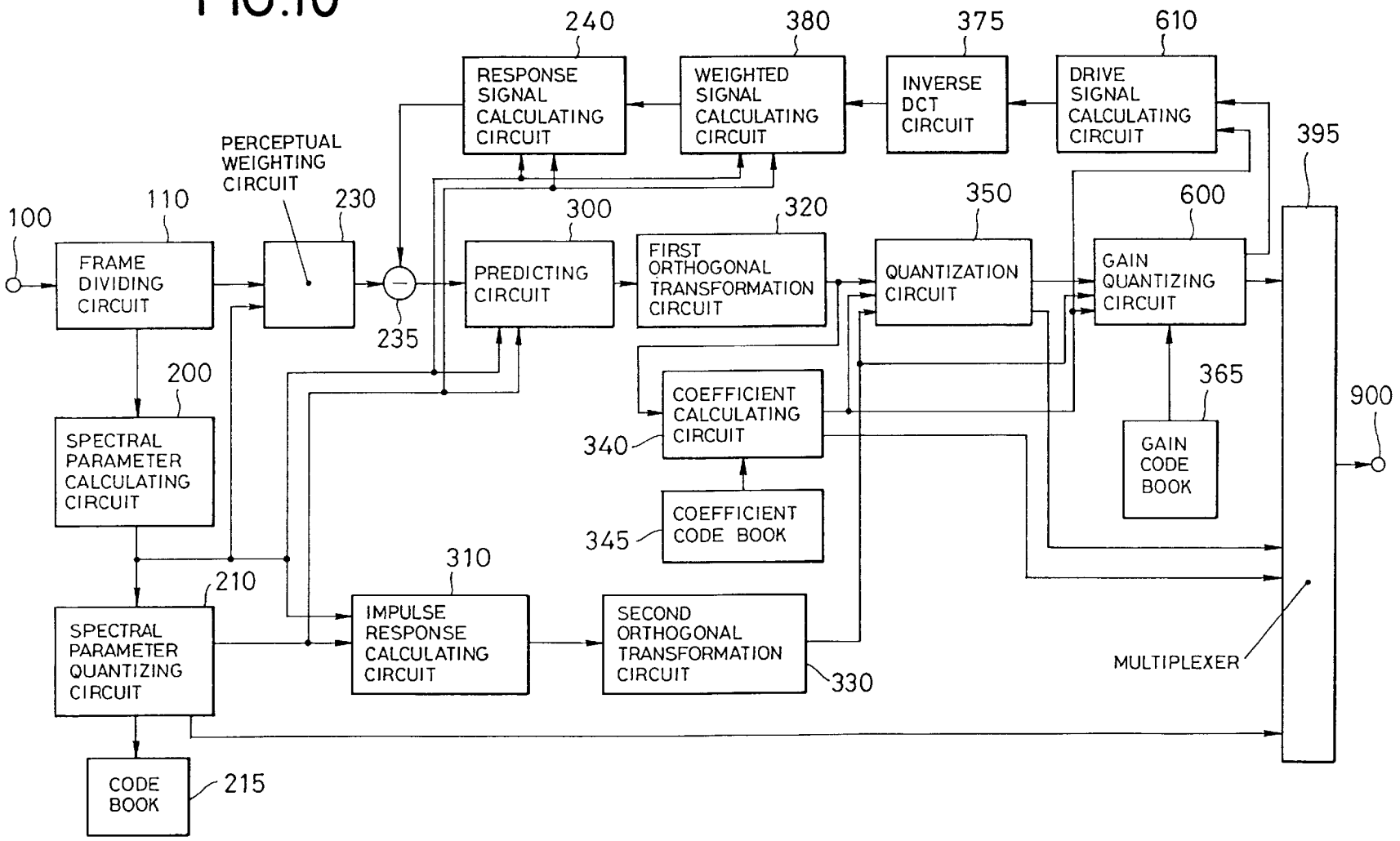
FIG. 10 is a block diagram showing a construction of the fifth embodiment of a signal coding system according to the present invention.

FIG. 10 is an illustration showing a construction of the fifth embodiment of the signal coding system according to the present invention. In FIG. 10, like components to those in FIGS. 1 and 7 to 8 are identified by like reference numerals and detailed description for such common components will be neglected to avoid redundant discussion to keep the disclosure simple enough for facilitating clear understanding of the present invention. The system shown in FIG. 10 is differentiated from the system shown in FIG. 1 a gain quantization circuit 600 and a drive signal calculating circuit 610. The discussion for these components will be given hereinafter.

The gain quantization circuit 600 receives the envelop components EV(K) (K=0, . . . , N−1) from the coefficient calculating circuit 340 to retrieve an optimal gain code vector from a gain code book which makes the following equation (15) minimum by using a gain code book 365. Then, the gain quantization circuit 600 outputs the index representative of the optimal gain code vector to the multiplexer 395 and a gain code vector value to a drive signal calculating circuit 610.

$$D_j = \sum_{K=0}^{N-1} W(K)\left[E(K) - G'_i EV(K)\sum_{i=1}^{M} A'_i\delta(n-m_i)\right]^2 \tag{15}$$

wherein $G'_j$ and $A'_j$ are the gain code vector in the (j)th order and an amplitude of the pulse of the (i)th order.

The drive signal calculating circuit 610 receives the index and the envelop EV(K), respectively and reads out the code vector corresponding to the index. Then, the drive signal calculating circuit 610 derives a driving sound source signal V(K) through the following equation (16) and outputs the same.

$$V(K) = G'_j EV(K)\sum_{i=1}^{M} A'_i\delta(n-m_i) \tag{16}$$

Figure 11:
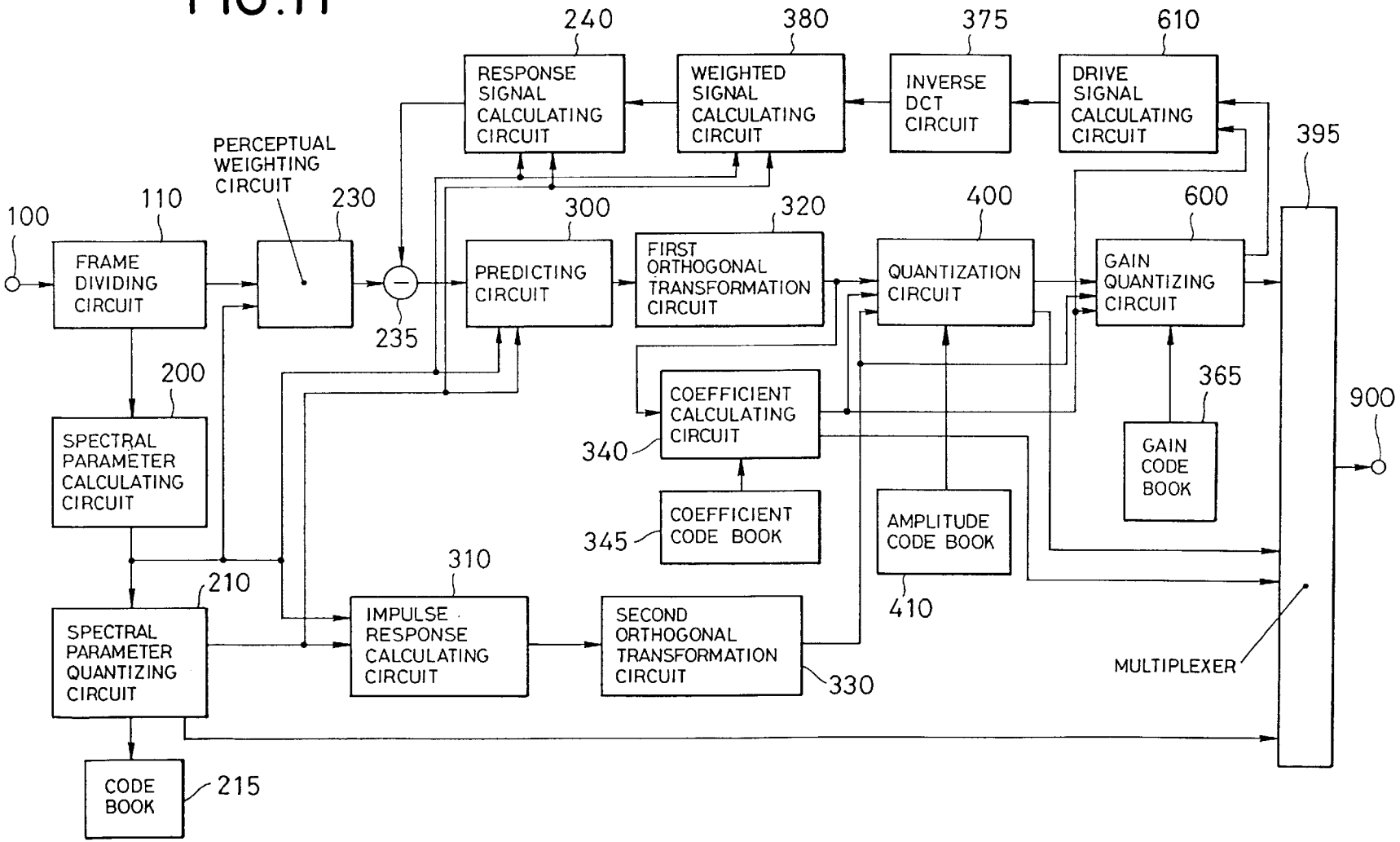
FIG. 11 is a block diagram showing a construction of the sixth embodiment of a signal coding system according to the present invention.

FIG. 11 is a block diagram showing a construction of the sixth embodiment of the signal coding system according to the present invention. In FIG. 11, like components to those in FIGS. 1, 7 to 10 are identified by like reference numerals and detailed description for such common components will be neglected to avoid redundant discussion to keep the disclosure simple enough for facilitating clear understanding of the present invention. The construction and operation other than those are the same as those set forth above.

The system illustrated in FIG. 11 is differentiated from the system shown in FIG. 10 in that the quantization circuit 400 and the amplitude code book 410 are used. The construction and operation other than those are the same as those set forth above.

Figure 12:
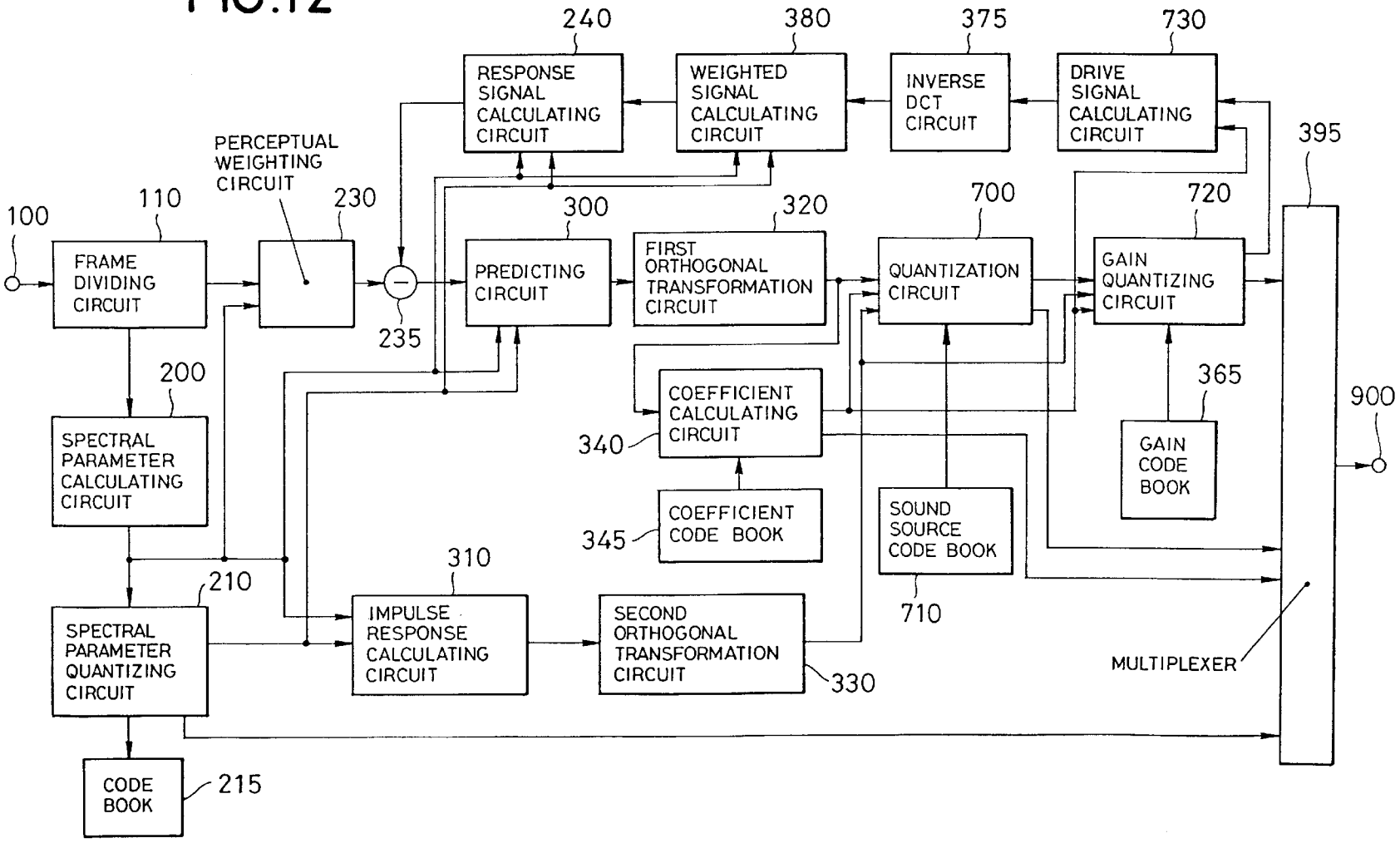
FIG. 12 is a block diagram showing a construction of the seventh embodiment of a signal coding system according to the present invention.

FIG. 12 is a block diagram showing a construction of the seventh embodiment of the signal coding system according to the present invention. In FIG. 12, like components to those in FIGS. 1, 7 to 11 are identified by like reference numerals and detailed description for such common components will be neglected to avoid redundant discussion to keep the disclosure simple enough for facilitating clear understanding of the present invention.

In the system illustrated in FIG. 12, a quantization circuit 700 quantizes the first orthogonal transformation coefficient by selecting the code vector minimizing the following equation (17) among the code vectors stored in a sound source code book 710, using the envelop EV(K) as the output of the coefficient calculating circuit 340 and the output of the second orthogonal transformation circuit 330.

$$D_j = \sum_{K=0}^{N-1} W(K)[E(K) - GEV(K)c_j(K)]^2 \tag{17}$$

wherein $c_j(K)$ is the code vector of the (j)th order. On the other hand, G is an optimal gain. It should be noted that the code book may be held for all bands or dedicated code books per sub bands by preliminarily dividing into sub-bands.

A gain quantization circuit 720 retrieves the gain code book 365 for minimizing the following equation (18) to select the optimal gain code vector. On the other hand, the index representative of the optimal gain code vector thus selected is output to the multiplexer 395 and the gain code vector value is output to a drive signal calculating circuit 730.

$$D = \sum_{K=0}^{N-1} W(K)[E(K) - G'_j EV(K)c_j(K)]^2 \tag{18}$$

wherein $G'_j$ represents the gain code vector in the (j)th order.

The drive signal calculating circuit 730 receives the index and the envelop EV(K), respectively to read out the code vector corresponding to the index for deriving the drive sound source signal V(K) through the following equation (19).

$$V(K)=G'_j EV(K)c_j(K) \tag{19}$$

Figure 13:
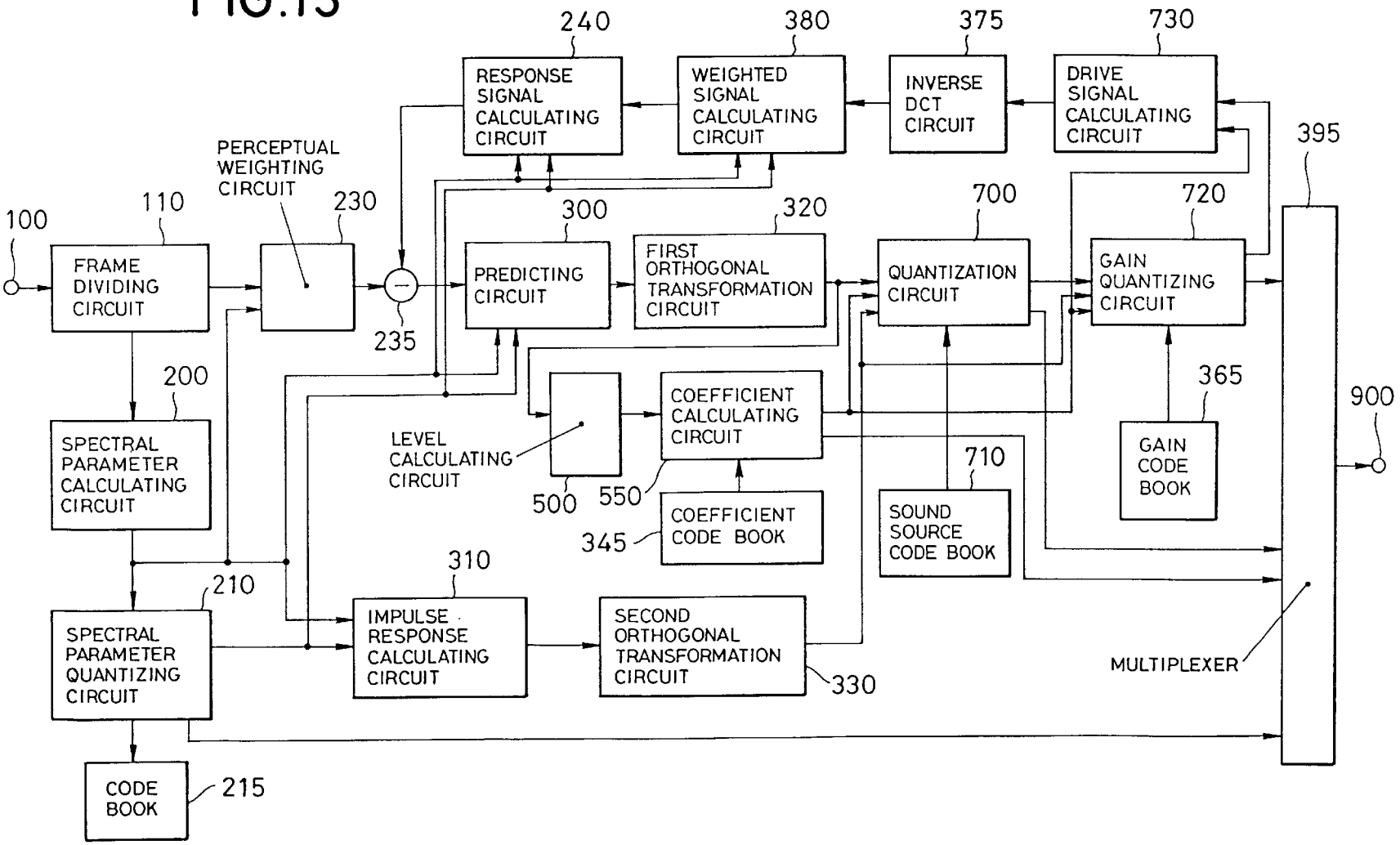
FIG. 13 is a block diagram showing a construction of the eighth embodiment of a signal coding system according to the present invention.

FIG. 13 is a block diagram showing a construction of the eighth embodiment of the signal coding system according to the present invention. In FIG. 13, like components to those in FIGS. 1, 7 to 12 are identified by like reference numerals and detailed description for such common components will be neglected to avoid redundant discussion to keep the disclosure simple enough for facilitating clear understanding of the present invention.

The system shown in FIG. 13 is constructed by constructing the quantization circuit 700, the sound source code book 710, the gain quantization circuit 720, the drive signal calculating circuit 730 in the same construction as those of the system shown in FIG. 12, in the system shown in FIG. 8. The construction and operation other than those are the same as those set forth above. Therefore, detailed description for such common components and operation thereof will be neglected to avoid redundant discussion to keep the disclosure simple enough for facilitating clear understanding of the present invention.

Figure 14:
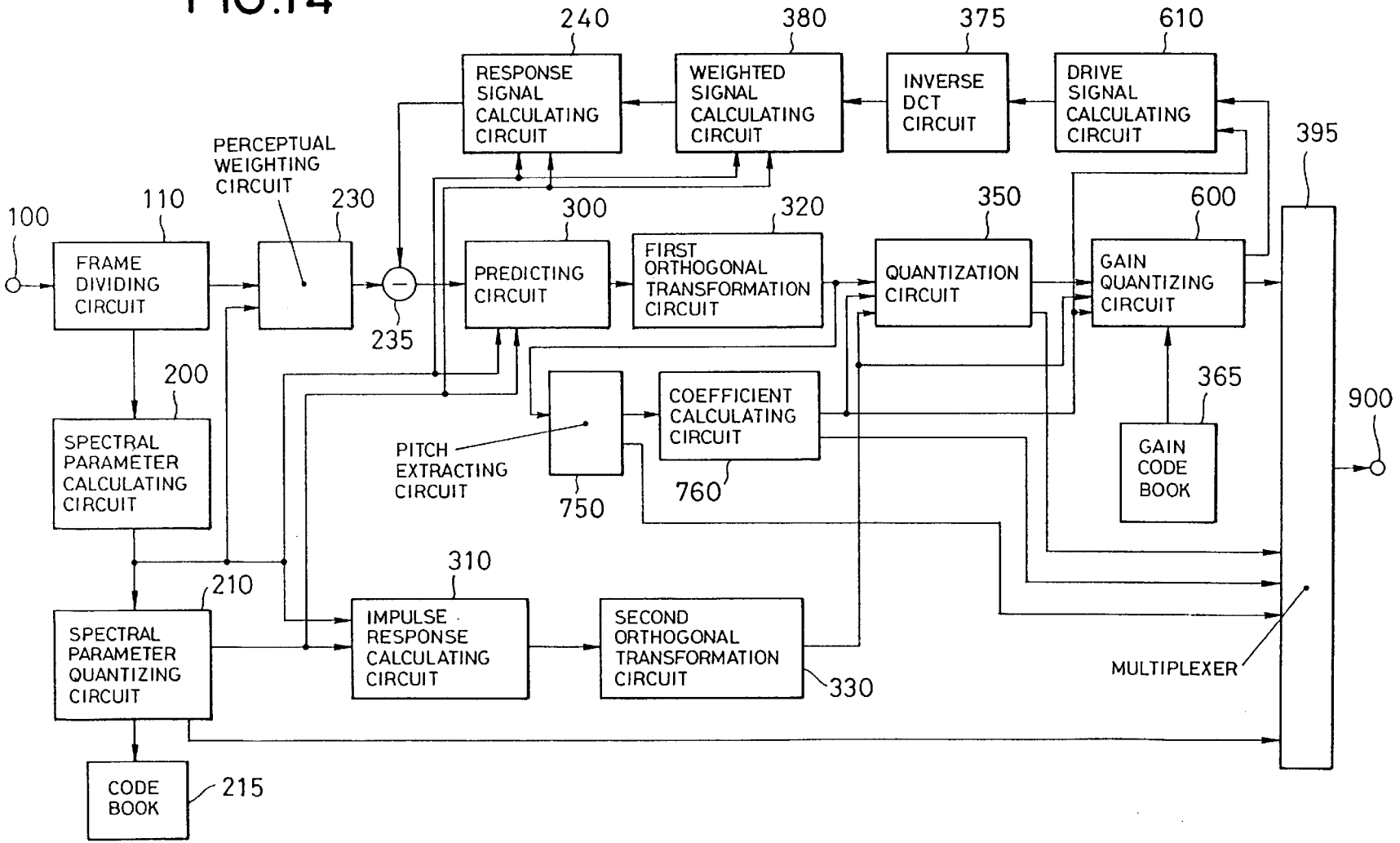
FIG. 14 is a block diagram showing a construction of the ninth embodiment of a signal coding system according to the present invention.

FIG. 14 is a block diagram showing a construction of the ninth embodiment of the signal coding system according to the present invention. In FIG. 14, like components to those in FIGS. 1, 7 to 13 are identified by like reference numerals and detailed description for such common components will be neglected to avoid redundant discussion to keep the disclosure simple enough for facilitating clear understanding of the present invention. In FIG. 14, a pitch extraction circuit 750 calculates a pitch frequency expressing a fine structure (spectral fine structure) with respect to the orthogonal transformation coefficient as the output of the first orthogonal transformation circuit 320.

In practice, a square value $E^2(K)$ of the orthogonal transformation coefficient E(K) (K=0, . . . , N−1) as the output of the first orthogonal transformation circuit, is derived. With establishing two N points to make the square value symmetric with considering as power spectrum, inverse FFT of two N points is performed to take the first N point out to calculate the pseudo auto-correlation function R(j) (j=0, . . . , N−1) of the N point.

For R(j), the maximum value in a predetermined zone is retrieved. Except for the value, at which R(j) becomes maximum, all other values are set to "0". Furthermore, the degree, at which the maximum value is obtained, and the maximum value are coded as pitch lag and pitch gain and output to the multiplexer 395.

The coefficient calculating circuit 760 makes the quantized auto-correlation to be symmetric to establish two N points to perform two N point FFT to derive EV(K) (K=0, . . . , N−1) from the first N point to output to the quantization circuit 350 and the gain quantization circuit 600. EV(K) (K=0, . . . , N−1) represents the fine structure of the foregoing orthogonal transformation coefficient.

Figure 15:
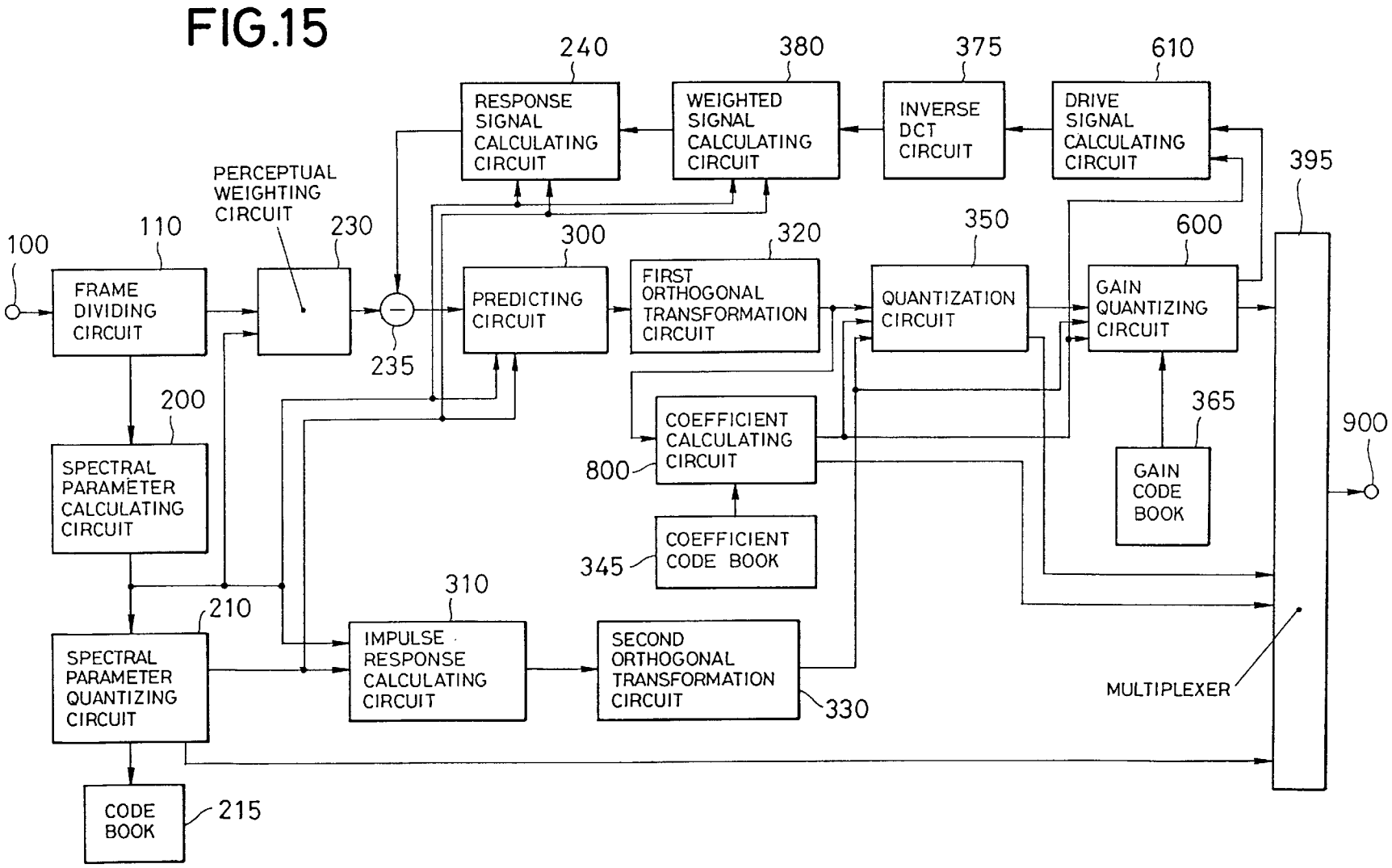
FIG. 15 is a block diagram showing a construction of the tenth embodiment of a signal coding system according to the present invention.

FIG. 15 is a block diagram showing a construction of the tenth embodiment of the signal coding system according to the present invention. In FIG. 15, like components to those in FIGS. 1, 7 to 14 are identified by like reference numerals and detailed description for such common components will be neglected to avoid redundant discussion to keep the disclosure simple enough for facilitating clear understanding of the present invention.

In FIG. 15, a coefficient calculating circuit 800 derives the coefficient of a smaller degree to represent the fine structure of the first orthogonal transformation coefficient and the envelop. In this case, the coefficient of smaller degree P (P<<N) for expressing the envelop of the square value of the orthogonal transformation coefficient E(K) (K=0, . . . , N−1) as the output of the first orthogonal transformation circuit is derived. In practice, the square value $E^2(K)$ of the amplitude of a respective coefficient of E(K) is derived. The square value $E^2(K)$ of the amplitude is considered as the power spectrum to make it symmetric to establish two N points. Then, for these two N points, an inverse FFT is performed to take out the first N point to calculate the pseudo auto-correlation function R(j) (j=0, . . . , N−1) of N point.

Also, in order to express with the coefficient of the smaller degree, among auto-correlation function of N point, (P+1) point is taken out from the first to perform the P degree LPC analysis to calculate the P degree linear predictive coefficient $\beta_i$ (i=1, . . . , P). This is transformed into an LSP coefficient of P degree to quantize the LSP coefficient using the coefficient code book 345 to output the index thereof to the multiplexer 395.

Returning the quantized LSP coefficient into the linear predictive coefficient $\beta'_i$, the impulse response l(n) (n=0, . . . , Q−1) (Q·N) of the filter. On the basis of the impulse response, the auto-correlation R' (j) (j=0, . . . , N−1) of the N point is derived.

On the other hand, for R(j), the maximum value in the predetermined zone is retrieved. Also, the degree, to which the maximum value is attained, and the maximum value are output to the multiplexer 395 with coding as the pitch lag and the pitch gain. For the auto-correlation R' (j), the coded maximum value is set at the position of the pitch lag is established to make it symmetric to establish two N points to perform the two N points FFT. Thus, EV(K) (K=0, . . . , N−1) from the first N point is output to the quantization circuit 350. EV(K) (K=0, . . . N−1) represents the fine structure of the orthogonal transformation coefficient and the envelop component.

As set forth above, in the present invention disclosed hereabove, the predictive residual error is subject to an orthogonal transformation to derive the orthogonal transformation coefficient. Then, the envelop of the orthogonal transformation coefficient or the envelop derived by calculating the average level per predetermined number of coefficients of the orthogonal transformation coefficient is expressed by the coefficient of the smaller degree. On the basis of the coefficient, the orthogonal transformation coefficient is expressed by a combination of the pulse trains to achieve higher efficiency in coding than that in the prior art.

On the other hand, according to the present invention, the predictive residual error is subject to orthogonal transformation to derive the orthogonal transformation coefficient. Then, the envelop of the orthogonal transformation coefficient or the envelop derived by calculating the average level per predetermined number of coefficients of the orthogonal transformation coefficient is quantized by expressing with the code book to achieve higher efficiency in coding than that in the prior art.

Furthermore, on the basis of the coefficient of smaller degree, good quantization performance can be obtained since quantization is performed with determining the gain of the pulse train and the code book. Then, not only the spectral envelop, but also the gain derived by the coefficient of the smaller degree is determined to express including the spectrum fine structure to improve quantization performance.

Although the present invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. A signal coding system for coding an input signal, said signal coding system comprising:

a spectral parameter calculating circuit which derives a spectral parameter of said input signal;

a predicting circuit which derives a predictive residual error based upon a result of a prediction of said input signal;

an orthogonal transformation circuit which derives an orthogonal transformation coefficient by performing an orthogonal transformation on said predictive residual error;

a coefficient calculating circuit which expresses an envelop of a plurality of said orthogonal transformation coefficients as a plurality of calculated coefficients; and a quantizer which quantizes said orthogonal transformation coefficients by expressing said orthogonal transformation coefficients as a plurality of pulses thereby producing a quantization result, said quantizer further outputs a combination of said spectral parameter, said calculated coefficients and said quantization result.

2. A signal coding system as set forth in claim 1, further comprising:

a level calculator which divides said orthogonal transformation coefficient derived by said orthogonal transformation circuit by a predetermined number and determines an average level for a plurality of said orthogonal transformation coefficients after said orthogonal transformation coefficients are divided by said predetermined number, and wherein said coefficient calculating circuit expresses an envelop of said average level derived by said level calculator using said plurality of calculated coefficients.

3. A signal coding system as set forth in claim 2, wherein said quantizer quantizes said orthogonal transformation coefficient using a code book.

4. A signal coding system as set forth in claim 2, wherein said quantizer produces said plurality of pulses by generating said pulses based upon amplitudes of said calculated coefficients.

5. A signal coding system as set forth in claim 2, wherein said quantizer quantizes said orthogonal transformation coefficient as combinations of a plurality of pulses by operating said pulses based upon amplitudes of said calculated coefficients.

6. A signal coding system as set forth in claim 2, wherein said quantizer quantizes said orthogonal transformation coefficient as combinations of a plurality pulses by generating said pulses with respective gains based upon amplitudes of said calculated coefficients.

7. A signal coding system as set forth in claim 2, wherein said coefficient calculator further calculates a coefficient expressing a fine structure of said orthogonal transformation coefficient.

8. A signal coding system as set forth in claim 2, wherein said quantizer quantizes said orthogonal transformation coefficient by aggregating one or more amplitudes of said pulses.

9. A signal coding system as set forth in claim 2, wherein said quantizer quantizes said orthogonal transformation coefficient by aggregating one or more polarities of said pulses.

10. A signal coding system as set forth in claim 2, wherein said predicting circuit predicts said input signal using said spectral parameter derived from said input signal.

11. A signal coding system as set forth in claim 2, wherein said input signal is a voice signal.

12. A signal coding system as set forth in claim 2, wherein said input signal is a musical signal.

13. A signal coding system as set forth in claim 1, wherein said quantizer quantizes said orthogonal transformation coefficient using a code book.

14. A signal coding system as set forth in claim 1, wherein said quantizer produces said plurality of pulses by generating said pulses based upon amplitudes of said calculated coefficients.

15. A signal coding system as set forth in claim 1, wherein said quantizer quantizes said orthogonal transformation coefficient as combinations of a plurality of pulses by generating said pulses based upon amplitudes of said calculated coefficients.

16. A signal coding system as set forth in claim 1, wherein said quantizer quantizes said orthogonal transformation coefficient as combinations of a plurality of pulses by generating said pulses with respective gains based upon amplitudes of said calculated coefficients.

17. A signal coding system as set forth in claim 1, wherein said coefficient calculator further calculates a coefficient expressing a fine structure of said orthogonal transformation coefficient.

18. A signal coding system as set forth in claim 17, wherein said quantizer quantizes said orthogonal transformation coefficient using a code book.

19. A signal coding system as set forth in claim 1, wherein said quantizer quantizes said orthogonal transformation coefficient by aggregating one or more amplitudes of said pulses.

20. A signal coding system as set forth in claim 1, wherein said quantizer quantizes said orthogonal transformation coefficient by aggregating one or more polaritics of said pulses.

21. A signal coding system as set forth in claim 1, wherein said predicting circuit predicts said input signal using said spectral parameter derived from said input signal.

22. A signal coding system as set forth in claim 1, wherein said input signal is a voice signal.

23. A signal coding system as set forth in claim 1, wherein said input signal is a musical signal.

24. A signal coding system for coding an input signal, said signal coding system comprising:

a spectral parameter calculating circuit which derives a spectral parameter of said input signal;

a predicting circuit which derives a predictive residual error based upon a result of a prediction of said input signal;

an orthogonal transformation circuit which derives an orthogonal transformation coefficient by performing an orthogonal transformation on said predictive residual error;

a coefficient calculating circuit which calculates a plurality of calculated coefficients by expressing a fine structure of a plurality of said orthogonal transformation coefficients; and a quantizer which quantizes said orthogonal transformation coefficients by expressing said orthogonal transformation coefficients as a plurality of pulses thereby producing a quantization result, said quantizer further outputs a combination of said spectral parameter, said calculated coefficients and said quantization result.

25. A signal coding system as set forth in claim 24, wherein said quantizer quantizes said orthogonal transformation coefficient using a code book.

26. A signal coding system for coding an input signal, said signal coding system comprising:

a spectral parameter calculating circuit which derives a spectral parameter of said input signal;

a predicting circuit which derives a predictive residual error based upon a result of a prediction of said input signal;

an orthogonal transformation circuit which derives an orthogonal transformation coefficient by performing an orthogonal transformation on said predictive residual error;

a coefficient calculating circuit which calculates a plurality of calculated coefficients by expressing a fine structure of a plurality of said orthogonal transformation coefficients;

a quantizer which quantizes said orthogonal transformation coefficients by expressing said orthogonal transformation coefficients as a plurality of pulses thereby producing a quantization result, said quantizer further outputs a combination of said spectral parameter, said calculated coefficients and said quantization result; and a level calculator which divides each orthogonal transformation coefficient derived by said orthogonal transformation circuit by a predetermined number and determines an average level for a plurality of said orthogonal transformation coefficients after said orthogonal transformation coefficients are divided by said predetermined number;

wherein said coefficient calculating circuit further expresses an envelop of said average level derived by said level calculator using said plurality of calculated coefficients.

27. A method for coding an input signal, said method comprising the acts of:

deriving a spectral parameter of said input signal;

deriving a predictive residual error based upon a result of a prediction of said input signal;

performing an orthogonal transformation on said predictive residual error to produce an orthogonal transformation coefficient;

representing an envelop of a plurality of said orthogonal transformation coefficients as a plurality of calculated coefficients;

quantizing said orthogonal transformation coefficients by expressing said orthogonal transformation coefficients as a plurality of pulses thereby producing a quantization result;

outputting a combination of said spectral parameter, said calculated coefficients and said quantization result; and coding said input signal using said combination.

* * * * *

UNITED STATES PATENT AND TRADEMARK OFFICE

CERTIFICATE OF CORRECTION

PATENT NO. : 6,208,962 B1
DATED : March 27, 2001
INVENTOR(S) : Kazunori Ozawa

It is certified that error appears in the above-identified patent and that said Letters Patent is hereby corrected as shown below:

Title page,
Item [56], References Cited, under "OTHER PUBLICATIONS", please add a listing for -- N. Gonzalez-Prelcic, et al.: "A Multipulse-like Wavelet-based Speech Coder" Applied Signal Processing, 1996, Springer-Verlag, UK, vol. 3, no. 2, pp. 78-87. --.

Signed and Sealed this

Sixteenth Day of July, 2002

*Attest:*

*Attesting Officer*

JAMES E. ROGAN
*Director of the United States Patent and Trademark Office*